United States Patent [19]

Mitchell et al.

[11] Patent Number: 4,597,689

[45] Date of Patent: Jul. 1, 1986

[54] LATCHING MEANS

[75] Inventors: Keith J. Mitchell; Norman R. Barber; Michael Ward, all of Kent, England

[73] Assignee: GEC Mechanical Handling Limited, England

[21] Appl. No.: 647,720

[22] Filed: Sep. 5, 1984

[30] Foreign Application Priority Data

Sep. 9, 1983 [GB] United Kingdom ..... 8324195

[51] Int. Cl.[4] ..... F16B 21/00; B63B 21/56

[52] U.S. Cl. ..... 403/322; 114/247; 114/252; 414/138

[58] Field of Search ..... 403/322, 321; 114/247, 114/253, 252, 199; 294/82.1, 82.32, 91, 97; 280/504, 515, 512, 513; 414/137, 138

[56] References Cited

U.S. PATENT DOCUMENTS

| | | | |
|---|---|---|---|
| 2,443,629 | 6/1948 | Matuszewski | 114/252 |
| 3,043,614 | 7/1962 | Eichmann | 403/321 |
| 3,059,590 | 10/1962 | Feiler et al. | 414/138 |
| 3,225,702 | 12/1965 | Hill | 414/138 |
| 3,445,133 | 5/1969 | Reischl | 403/321 |
| 3,589,299 | 6/1971 | Ingram | 414/138 |
| 3,675,794 | 7/1972 | Ingram et al. | 414/138 |
| 3,979,803 | 9/1976 | Clarke et al. | 294/82.32 |

*Primary Examiner*—Cornelius J. Husar
*Assistant Examiner*—Peter M. Cuomo
*Attorney, Agent, or Firm*—Kirschstein, Kirschstein, Ottinger & Israel

[57] ABSTRACT

A means for use in providing a connection between a cable and a movable body, more especially for R.A.S. systems, comprises a latching unit having means for attachment to said body and a recess associated with a latch, the arrangement also comprising a terminating member having means for attachment to the cable and being capable of introduction into the recess for engagement by the latch, the latter being associated with locking means for securing it in an operating position in which withdrawal of the terminating member is prevented, and release means for actuating the locking means to permit the latch to move to a release position so as to allow the terminating member to be withdrawn. Means may be provided for preventing inadvertent operation of the latch and accidental release of the member.

8 Claims, 8 Drawing Figures

LATCHING MEANS

Figure 1:
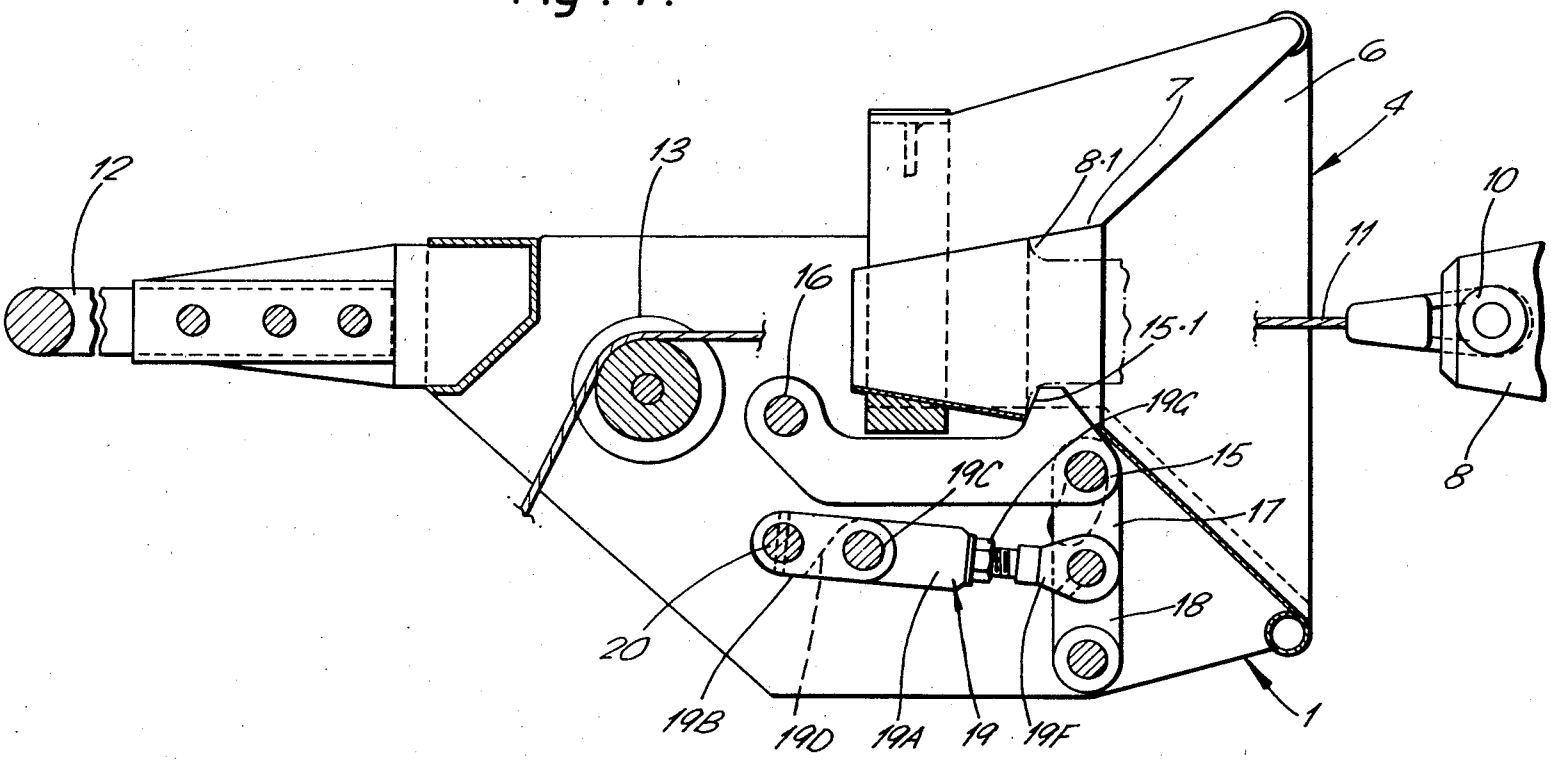

This invention relates to means for use in providing a connection between two relatively moveable bodies, more especially in systems employing a connecting means in the form of one or more cables, ropes or wires hereinafter referred to simply as cables, which, in turn, afford support for equipment for the transfer of liquids, solid objects and personnel between the two bodies.

Typically the invention can be used for the termination of the jackstay rope or flounder plate of a replenishment-at-sea system, the latter being, for example, an arrangement as claimed in UK Pat. No. 118771.

It is commonly required to transfer material or personnel from a supply ship to a receiving ship which does not possess a receiver arm but is provided with fixed high points. For this purpose it is necessary to connect a jackstay rope or flounder plate between the supply ship and the receiving ship.

One object of the invention is to provide an effective form of connection which can be rapidly released if this becomes necessary.

According therefore to one aspect of the invention a means for use in providing a connection between a cable and a moveable body comprises a latching unit incorporating means for attachment to said body, a recess and a latch capable of movement into an operating position in which a latching surface of the latch projects into the recess, the arrangement incorporating also a terminating member having means for attachment to a cable, and capable of introduction into latching position in the recess in which it is engageable by the latch, the latter being associated with locking means which holds it in the operating position and secures the terminating member against withdrawal, and release means for actuating the locking means to permit the latch to move into a release position so as to allow the terminating member to be withdrawn.

Preferably the latching surface of the latch has an inclination such that, on operation of the release means, the tension on the cable causes the terminating member to urge the latch by cam action towards the release position, thereby facilitating the rapid release of the terminating member from the latching unit.

In some cases the arrangment may include an inhibiting means capable of being set into a position in which it secures the release means against operation whereby release of the terminating member is prevented. This prevents accidental release of the terminating member, as the inhibiting means has to be set into a position in which it permits operation of the release means, and thus the latch to move into the release position.

Conveniently the locking means comprises a pair of pivoted link members forming a toggle joint which is arranged to be maintained in a substantially straightened condition for securing the latch in the operating position, and the release means is operable to cause the link members to pivot away from the straightened condition and thereby cause the latch to move to the release position.

The release means may for example comprise a further link connected to the junction of the pivoted link members, and having a locking position in which it secures the link members in the straightened condition, but capable of being actuated to pivot the link members away from said straightened condition.

The further link may be in the form of a broken bridge comprising a further pair of pivoted link members, one of which is connected to the junction of the link members forming the locking means, and the other of which is coupled to means for rotating the bridge into and out of the locking position.

Although the invention has its main application in transferring liquids, solids or personnel between two ships, e.g. naval replenishment-at-sea systems, it can also be used to advantage in systems employed for civilian purposes, such as the replenishment of or rescue of personnel from an offshore oil rig or platform and as well as improved safety, the ability to terminate the equipment by a latching technique has the advantage that the operation can be performed in a satisfactory manner by relatively untrained personnel. This aspect of the utility of the invention has great significance when it is used as part of a system for the rescue of personnel from a rig or platform where fire or some other emergency has occurred.

It will be understood, therefore, that the invention is also to be seen as a feature of and an improvement to a system such as the one disclosed in UK Pat. No. 2041320.

In some cases the connection of the terminating member to the latching unit may be made manually. However manual termination is time consuming and can be dangerous to personnel performing the operation.

Accordingly the terminating member may be provided with means for drawing it into the recess, the latter being appropriately shaped, for example as a funnel or cone, so as to guide the member into said latching position within the recess as it is drawn into it.

Figure 2:
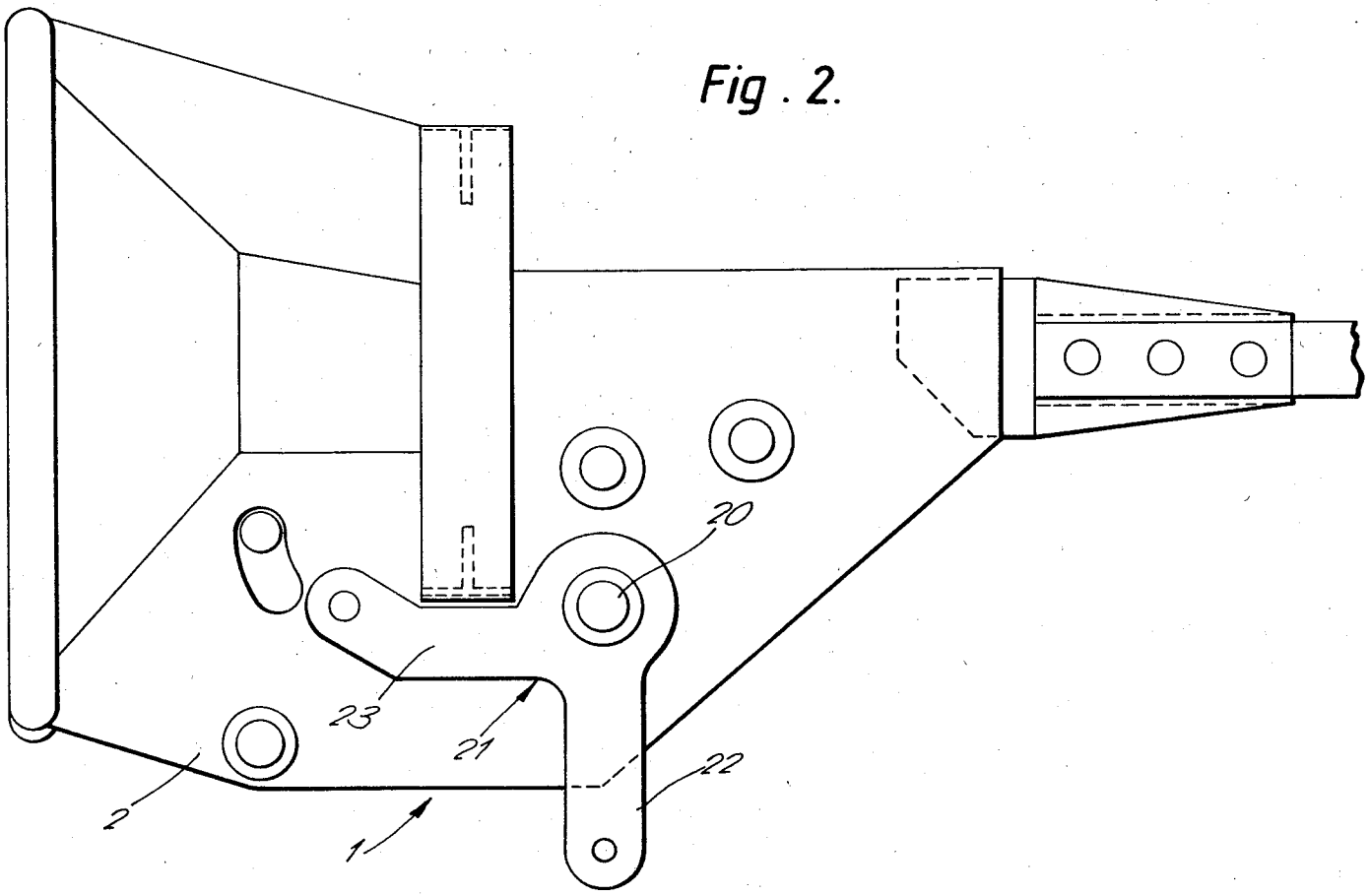
Figure 3:
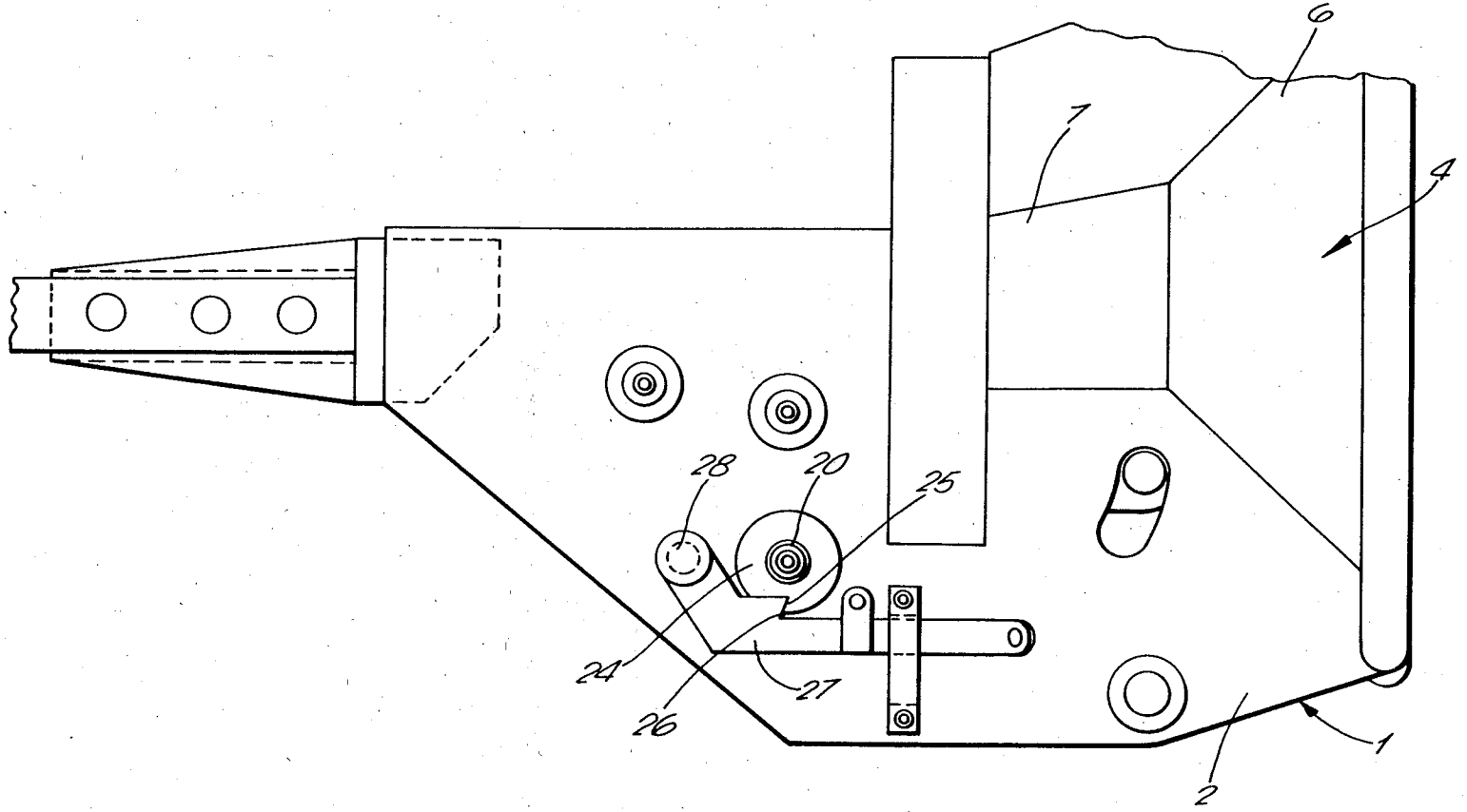
Figure 4:
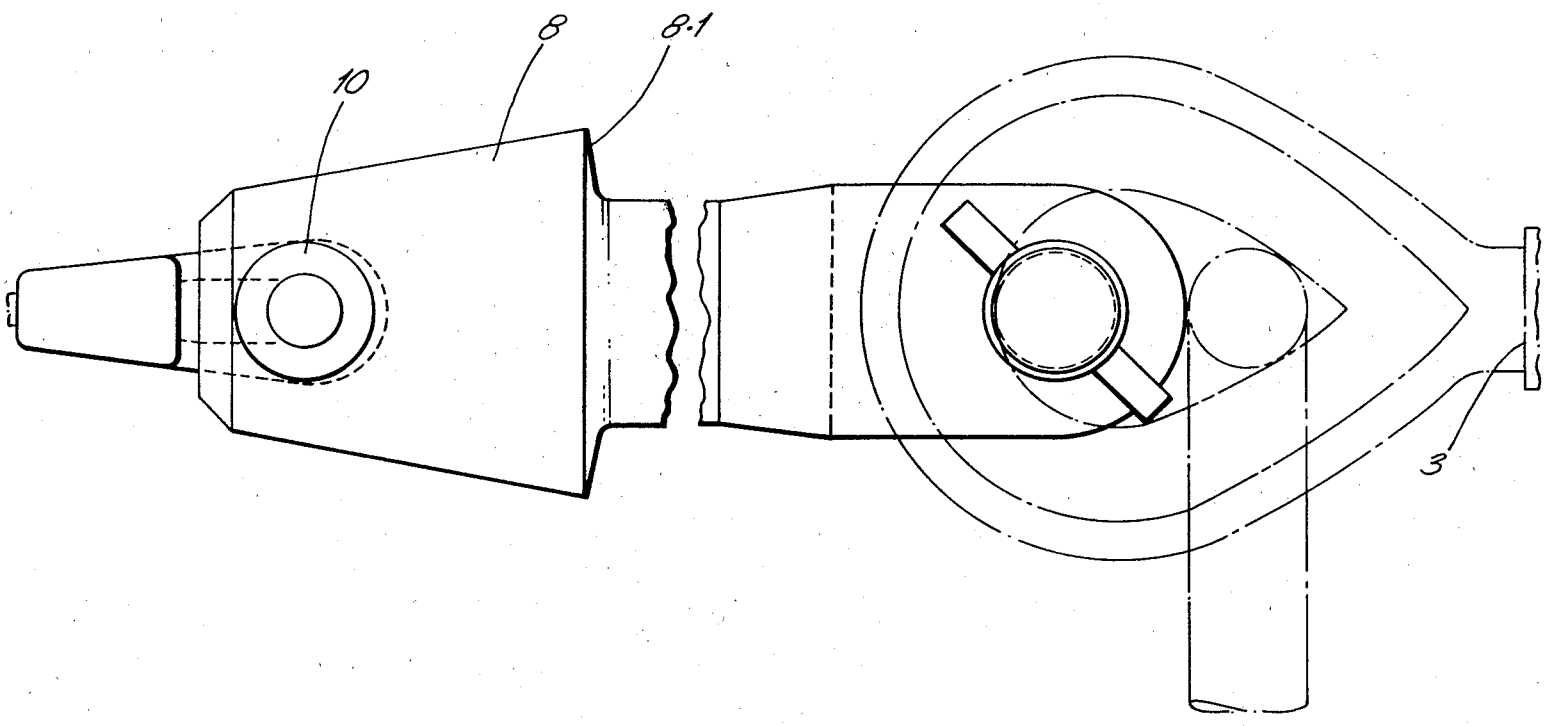

Several different embodiments of the invention will now be described, by way of example, with reference to FIGS. 1 to 8 of the accompanying schematic drawings, in which FIG. 1 represents a sectional view of the first latching unit, FIG. 2 and 3 represent views of the unit from opposite sides, and FIG. 4 illustrates a co-operating terminating member for use with the unit.

Figure 5:
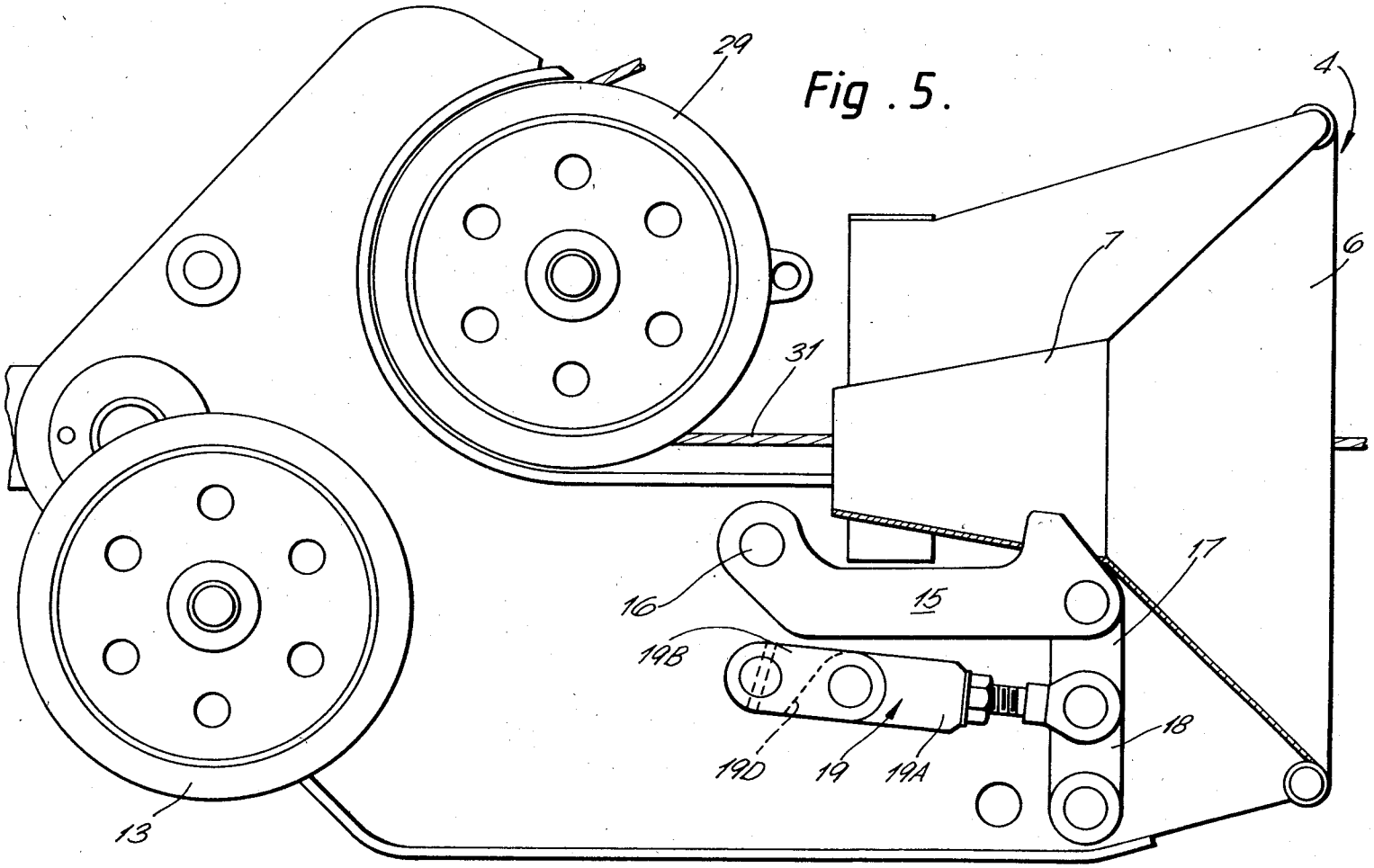
Figure 6:
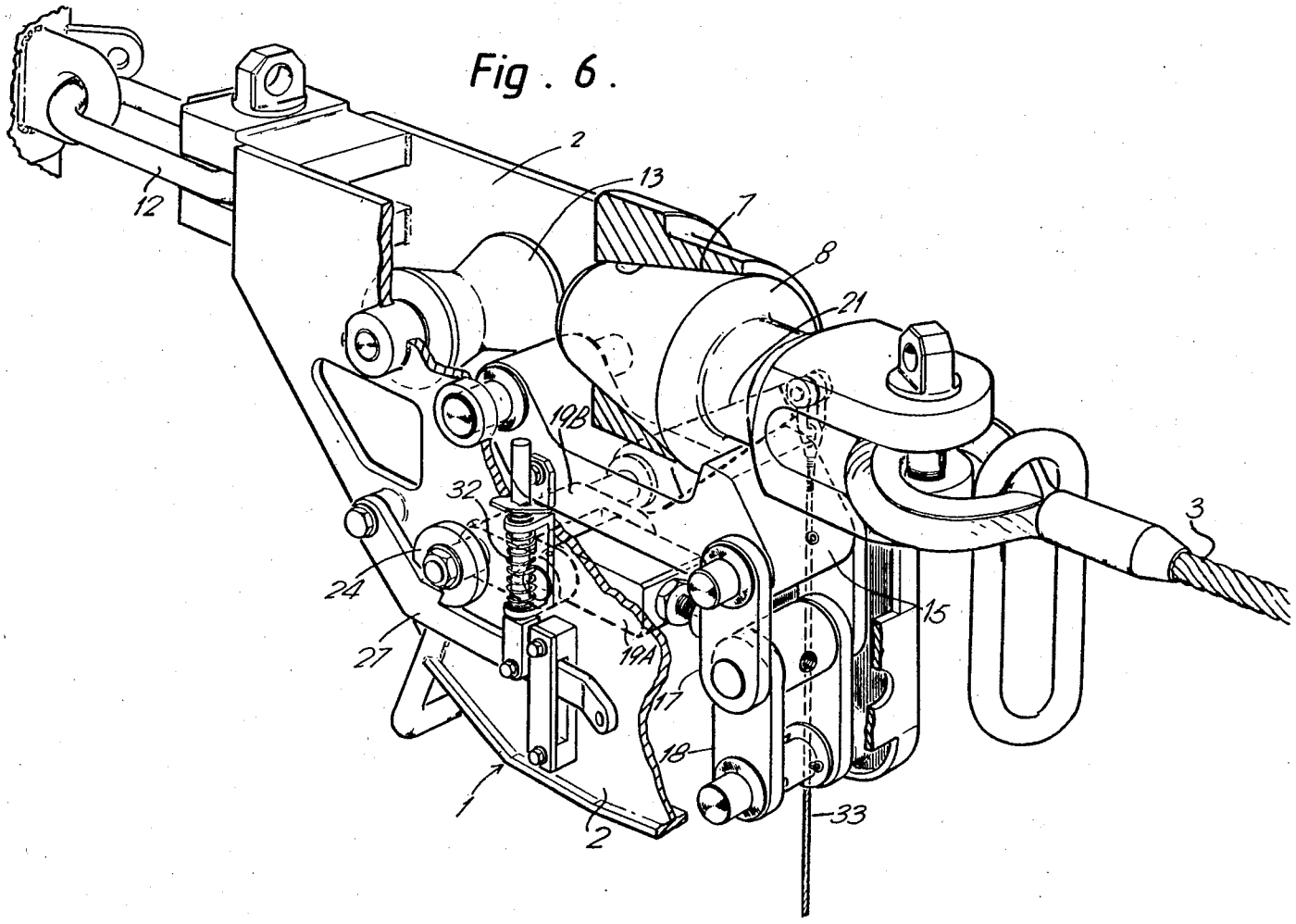
Figure 7:
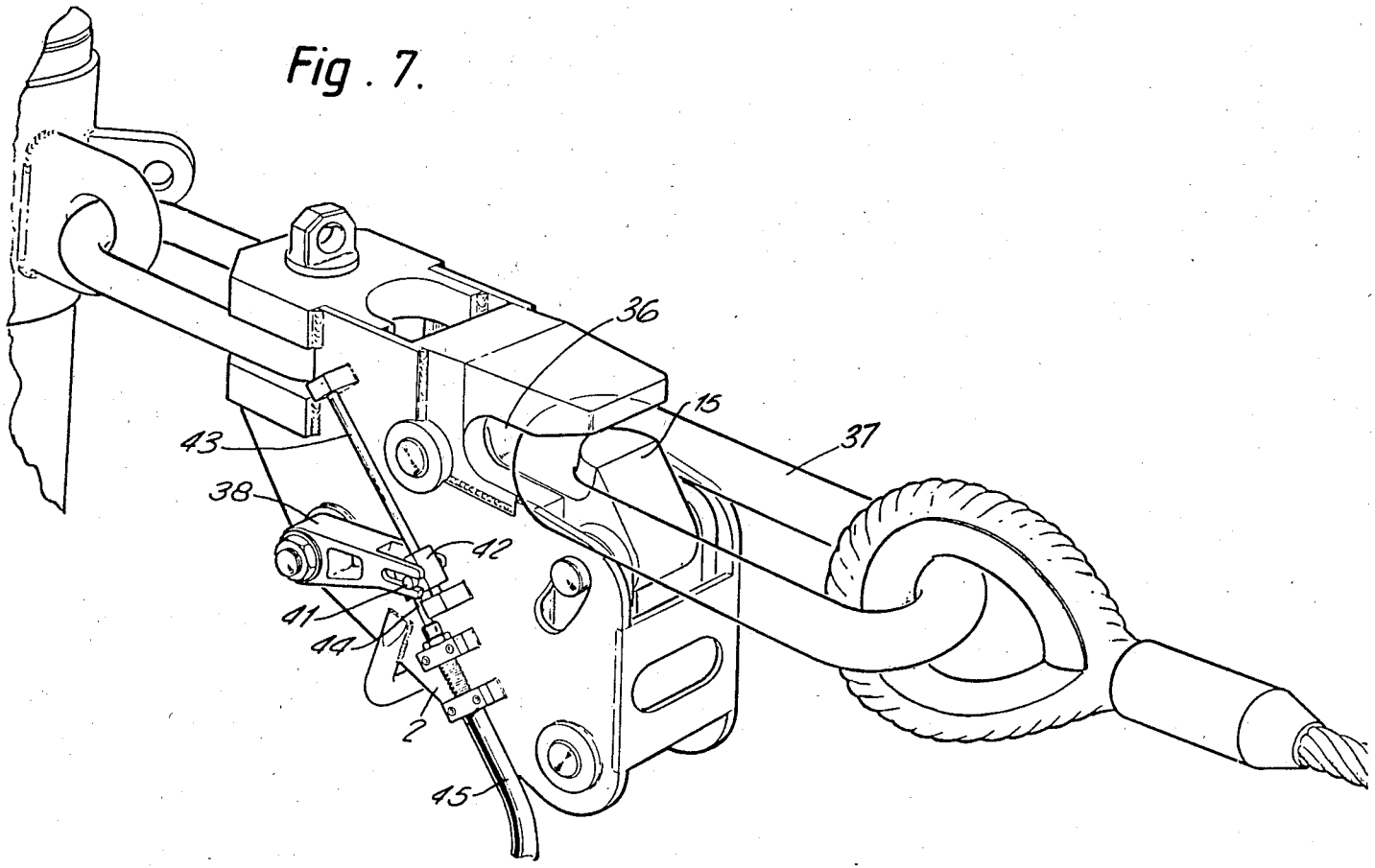
Figure 8:
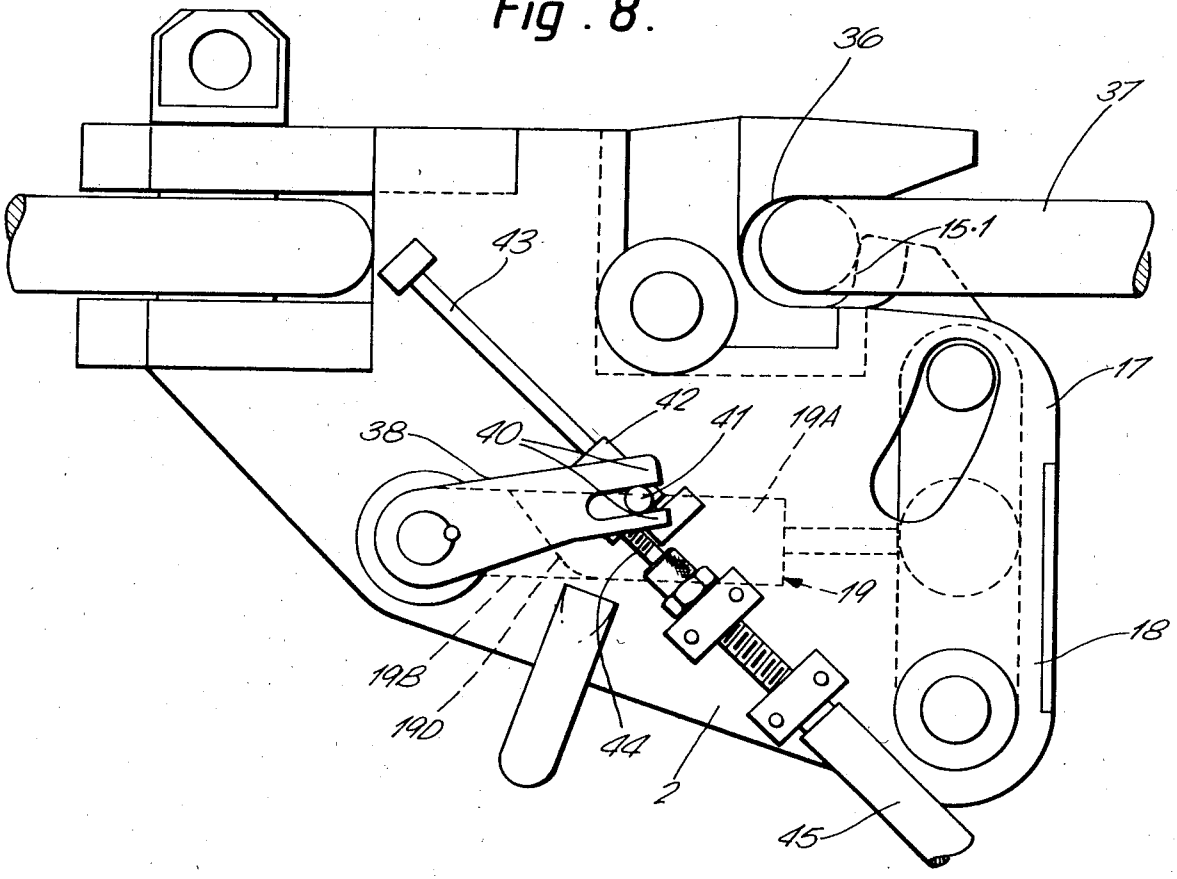

FIG. 5 represents a sectional view of a modified form of the unit illustrated in FIGS. 1 to 4, FIG. 6 represents a perspective view in part section of a further modification, and FIGS. 7 and 8 represent a perspective view and a side view respectively of a further embodiment.

Referring first to FIGS. 1 to 4, the latching unit, which is designed for mounting on a receiving ship, oil rig platform or the like, consists of a fabricated frame 1 which is made up from a pair of plates 2 which are spaced apart by suitable spacers. Attached to the frame is a conical guide assembly 4. The conical guide has two main sections 6 and 7, the inner one of which 7 is arranged to receive and latch a conical terminating device 8 which in turn is attached to a jackstay rope 3 of the replenishment-at-sea system, the terminating device being shown more clearly in FIG. 4. Additionally, the conical terminating device 8 is provided at its nose end with a means 10 for the attachment of a hauling rope 11 which is used during the process of hauling the jackstay 3 across to the vessel or body to which the automatic latching assembly is attached.

The latching assembly is itself connected for use to the receiving ship or the like by means of a further shackle or eye 12 and is so positioned prior to the commencement of the terminating operation. In the embodiment described, the terminating assembly is provided with a pulley 13. To connect the jackstay the hauling rope 11 which passes through the guide is led over the pulley 13 and hence to a suitable haulage winch not shown. In this case the procedure commences with the establishement between the two vessels or bodies of the haulage rope 11, the haulage winch the being used to haul across the conical terminating device 8 and hence the jackstay. Upon arrival in the area of the latching assembly the conical terminating device 8 is guided into the cone assembly 4 and is ultimately latched into position in the inner section 7 by means of a latch 15 engaging a shoulder 8.1 on the terminating unit 8.

The operation of the latch assembly will now be described. The latch 15 is pivotally attached between the two main side plates 2 and 3 on a pin 16 and is rotated about pin 16 by a three bar mechanism consisting of a pair of links 17 and 18 forming a toggle joing and a connecting link 19. The link 19 is provided with a "broken bridge" feature, that is to say it is provided with a block 19A which is pivotally attached to a specially shaped square section component 19B by a pin 19C. The component 19B is pinned to a cross shaft 20, the ends of which project through the side plates 2. The mating faces between 19A and 19B as shown at 19D limit the clockwise rotation of 19A relative to 19B as illustrated in FIG. 1. The square section component 19A is provided with a tapped hole in which is carried an adjustable eyebolt 19F which can be locked in position by a nut and washer 19G. This arrangement is provided to permit the correct setting up of the link mechanism regardless of the effects of small positional errors in the various locating holes in the two main side plates 2 and 3.

The inner end of the shaft 20 carries an actuating lever 21 (see FIG. 2) having a generally downwardly projecting arm 22 and a forwardly projecting arm 23 to which are attached operating cables (not shown).

Rotation of the lever 21 in the clockwise direction (as shown in FIG. 2) results in the straightening of the link 19 and hence of the links 17, 18, which produces an upward movement of the nose end of the latch 15 causing it to engage a surface 8.1 of the conical terminating device 8 when this has been fully hauled into the conical guide assembly.

The outer end of the shaft 20 carries a cam disc 24 having a locking surface 25 (see FIG. 3) which, when the link assembly 19 is rotated into the extended position to cause the latch 15 to secure the conical terminating device 8, is engaged by a co-operating surface 26 of a locking lever 27, pivotable to a limited extent about a pin 28, and urged upwards into the locking position by a spring (not shown). This is a safety feature to prevent the conical terminating device 8 being released accidentally, since it secures the shaft 20 from being rotated by the actuating lever 21 without first disengaging the locking lever 27 from the cam disc 24. However, the conical terminating device 8 can nevertheless be released very quickly in emergency situations by operating both the locking lever 27 and actuating lever 21, thereby breaking the "bridge" and so cause the pair of links 17, 18 to be pivoted away from the straightened condition, releasing the latch 15 from the terminating device 8.

It will be noted that the part of the surface 15.1 of the latch 15 and the shoulder 8.1 of the terminating device 8 are both inclined in such a manner that on release of the latch 15, the tension of the rope causes the shoulder to exert, by cam action, a force on the latch, which urges it towards the open position. This facilitates a very rapid release.

The invention thus provides a way of quickly and simply attaching a jackstay to and releasing it from a receiving ship, without the need for any dangerous manual connecting operations. Moreover, the connecting means is of relatively light and simple construction and may readily be carried permanently by a receiving ship. However, as it can be simply secured to an eyebolt, it can form part of a supply ship's equipment and simply transferred and fixed to a receiving ship not fitted with a receiving ship arm.

However, the invention is also applicable to use with rigs of the kind employing flounder plates. In one such case designed for connecting either a jackstay or flounder plate latching unit is provided, as shown in FIG. 5, with an additional pulley 29 located above the jackstay pulley 13, in this case shown larger than in FIGS. 1 to 3, to permit a haulage rope 31, which can also act as measuring wire, to pass downwards over the additional pulley 29, through the guide cone 4 to the conical terminating device 8, which is in this embodiment attached to the flounder plate (not shown). In connecting the flounder plate, the first step is to haul across to the receiving ship the haulage rope 31 and to pass this around the additional pulley 29 before returning it to the supply ship. In this case the haulage winch forms part of the equipment of the supply ship and the continuous loop of the haulage rope thus established is to enable the supply ship to haul across to the latching device its own flounder plate. In such a case the flounder plate travels on the upper strand of the continuous loop of haulage rope, this procedure being followed until, as before, the conical terminating device 8 is latched in to the cone unit 4 by means of the latch assembly 15.

In some cases, however, it may be desired to engage the terminating device 8 to the latching unit manually and two alternative embodiments of the invention for achieving this are illustrated in FIGS. 6 to 8.

Thus FIG. 6 illustrates a further modification of the latching arranagement described with reference to FIGS. 1 to 4 in which the conical terminating device 8 is arranged to be introduced manually into the concial guide recess 7. Accordingly the wider outer section 6 has been dispensed with. The same reference numerals have been used to denote the same parts of the equipment illustrated in the previous Figures, and in addition there is ullustrated the spring 32 which urges the locking lever 27 into the locking position. A cable for operating the actuating lever 21, in order to rotate the link 19 and hence the links 17, 18, when the locking lever 27 is operated to release the cam disc 24, and thereby allow the lever to release the terminating device 8, is also shown at 33.

FIGS. 7 and 8 illustrate an alternative latching arrangement for manual connection, the conical guide recess being completely dispensed with and being replaced by a simple slotted recess 36 for receiving a terminating link 37 at the end of the jackstay 3.

The links 17, 18 and 19 are retained although the parts 19A and 19B of the latter are disposed so that their mating faces 19D limit the anti-clockwise rotation of 19A relative to 19B from the straightened condition. The locking lever 27 and cam disc 26 are disposed with and the latter is replaced by an actuating lever 38 which effects the operation of the link 19 in place of the lever 21 of the previous exmaple which is also omitted. The actuating lever 38 has a forked outer end each limb of which has a pair of prongs 40 within which fits a respective spigot 41 carried by a block 42 slidably supported on an inclined rod 43 fixed to the outside of the adjacent plate 2. The block 42 has connected to it one end of the actuating wire 44 of a bowden cable 45, capable of producing an upward movement of the block 42 along the rod 43. This in turn rotates the actuating lever 38 (in the anticlockwise direction as illustrated) and consequently breaks the "bridge" provided by the lever 19, and causes the links 17, 18 to pivot away from the straightened condition, thereby releasing the latch 15 from the terminating link 37 and allowing it to be withdrawn from the recess 36.

In each of the further examples the latching surface 15.1 of the latch 15 is inclined in a similar manner to that of the unit illustrated in FIGS. 1 to 4 so that, upon release, the action of the terminating cone or link 8, 37, as the case may be, acts to urge the latching member towards the release position thereby facilitating a rapid release.

We claim:

1. An arrangement for use in providing a connection between a cable and a moveable body comprising a latching unit incorporating means for attachment to said body, a recess and a latch capable of movement into an operating position in which a latching surface of the latch projects into the recess, the arrangement incorporating also a terminating member having means for attachment to a cable, and capable of introduction into latching position in the recess in which it is engageable by the latch, the latter being associated with locking means which holds it in the operating position and secures the terminating member against withdrawal, release means for actuating the locking means to permit the latch to move into a release position so as to allow the terminating member to be withdrawn, and inhibiting means having a position in which it secures the release means against operation, whereby release of the terminating member is prevented, and manually movable to an alternative position in which it permits operation of the release means, and thus the latch to move into the release position.

2. A connection means according to claim 1 wherein the latching surface of the latch has an inclination such that, on operation of the release means, the tension on the cable causes the terminating member to urge the latch by cam action towards the release position, thereby facilitating the rapid release of the terminating member from the latching unit.

3. A connection means according to claim 1, wherein the locking means comprises a pair of pivoted link members forming a toggle joint which is arranged to be maintained in a substantially straightened condition for securing the latch in the operating position, and the release means is operable, when the inhibiting means has been moved to said alternative position to cause the link members to pivot away from the straightened condition and thereby cause the latch to move to the release position.

4. A connection means according to claim 3 wherein the release means comprises a further link connected to the pivot connecting the pivoted link members, and having a locking position in which it secures the link members in the straightened condition, but capable of being actuated to pivot the link members away from said straightened condition.

5. A connection means according to claim 4 in which said further link is in the form of a broken bridge comprising a further pair of pivoted link members, one of which is connected to the junction of the link members forming the locking means, and the other of which is coupled to means for rotating the bridge into and out of the locking position.

6. A connection means according to claim 5 wherein the inhibiting means is spring loaded into a position in which it prevents rotation of the bridge from the locking position, but is capable of being actuated against the spring loading into said alternative position in which it releases the bridge and allows it to be rotated out of the locking position.

7. A connection means according to claim 1 wherein the terminating member is provided with means for drawing it into the recess and the latter is shaped so as to guide the member into the latching position as it is drawn into the recess.

8. A connection means according to claim 7 wherein the recess and the terminating member are of approximately conical shape.

* * * * *